US008857736B1

(12) United States Patent
Finger et al.

(10) Patent No.: US 8,857,736 B1
(45) Date of Patent: Oct. 14, 2014

(54) WASHING SYSTEM AND METHOD

(75) Inventors: John W. Finger, Beresford, SD (US); Bradley A. Hyronimus, Beresford, SD (US); Mark Kayne, Beresford, SD (US)

(73) Assignee: Sioux Corporation, Beresford, SD (US)

( * ) Notice: Subject to any disclaimer, the term of this patent is extended or adjusted under 35 U.S.C. 154(b) by 530 days.

(21) Appl. No.: 13/248,495

(22) Filed: Sep. 29, 2011

(51) Int. Cl.
*B05B 1/24* (2006.01)

(52) U.S. Cl.
USPC ..... 239/135; 239/569

(58) Field of Classification Search
CPC ..... B05B 1/24; B05B 7/16; B05B 1/3006; B05B 7/005; B05B 7/2424
USPC ..... 239/135, 124, 569, 570, 571, 303, 310
See application file for complete search history.

(56) References Cited

U.S. PATENT DOCUMENTS 3,760,982 A 9/1973 Haase
4,034,911 A 7/1977 Baysinger
4,144,846 A 3/1979 Miszak
4,663,613 A 5/1987 Raleigh
4,776,301 A 10/1988 Dziubakowski
4,922,861 A 5/1990 Tsutsui
5,623,990 A 4/1997 Pirkle
6,006,398 A * 12/1999 Larson et al. ..... 15/314
6,084,218 A 7/2000 McDonough
6,435,424 B1 8/2002 Pauley et al.
6,694,927 B1 2/2004 Puchak

* cited by examiner

*Primary Examiner* — Davis Hwu
(74) *Attorney, Agent, or Firm* — Jeffrey A. Proehl; Woods, Fuller, Shultz & Smith, P.C.

(57) ABSTRACT

A system for heating and pressurizing fluid that defines a primary fluid flow path, and may comprise a fluid inlet into the flow path for receiving fluid at an initial fluid temperature, a fluid outlet out of the flow path, a fluid pump configured to raise the pressure of the fluid in the fluid path, and a flow diverter valve configured to divert fluid flow from the primary fluid flow path to a secondary fluid flow path. A fluid heating device may be configured to heat fluid passing through the primary fluid path, and may be incapable of heating the fluid from a first inlet temperature range to the outlet temperature in an outlet temperature range, but is capable of heating the fluid from a second inlet temperature range to the outlet temperature in the outlet temperature range.

20 Claims, 2 Drawing Sheets

WASHING SYSTEM AND METHOD

BACKGROUND

1. Field

The present disclosure relates to washing apparatus and more particularly pertains to a new washing system and method that provides the benefits of high pressure hot fluid cleaning from a more compact and lower power apparatus by utilizing preheated fluid typically available.

2. Description of the Prior Art

It is often desirable to clean using a very hot fluid, such as water heated to a temperature and pressure such that steam is created when the water at high temperature and pressure is exposed to atmospheric pressure. However, systems capable of producing such temperatures and pressures tend to be large and expensive, which in turn tends to limit the facilities that can utilize such systems. Cleaning with high temperature fluids and steam is highly effective in food production facilities such as the kitchens of restaurants, but the practicality is limited by the aforementioned size and expense of systems having this capability.

SUMMARY

In view of the foregoing disadvantages inherent in the known types of washing apparatus now present in the prior art, the present disclosure describes a new washing system and method which may be utilized for providing the benefits of high pressure hot fluid cleaning from a more compact and lower power apparatus.

In one aspect, the present disclosure relates to a system for heating and pressurizing fluid to an outlet temperature and an outlet pressure, and the system defines a primary fluid flow path. The system may comprise a fluid inlet defining an inlet into the primary fluid flow path for receiving fluid at an initial fluid temperature, and a fluid outlet defining an outlet from the primary fluid flow path. The system may comprise a fluid pump in fluid communication with the primary fluid flow path and configured to raise the pressure of the fluid moving along the fluid path, and a flow diverter valve in communication with the primary fluid flow path and configured to divert fluid flow from the primary fluid flow path to a secondary fluid flow path when pressure of the fluid on the primary fluid flow path reaches a first threshold pressure. The system may further comprise a fluid heating device in communication with the primary fluid flow path and configured to heat fluid passing through the fluid heating device. The fluid heating device is incapable of heating the fluid in the primary fluid flow path from a first inlet temperature range to the outlet temperature in an outlet temperature range, but the fluid heating device is capable of heating the fluid in the primary fluid flow path from a second inlet temperature range to the outlet temperature in the outlet temperature range.

In another aspect, the disclosure relates to a method of heating and pressuring fluid for cleaning. The method may include steps of receiving a fluid at an initial temperature at an inlet of a primary fluid flow path of a system for heating and pressurizing fluid, with the fluid being preheated to the initial temperature prior to receipt by the system. The method may also include the step of pumping the fluid in the primary fluid flow path to increase the pressure of the fluid, and heating the fluid in the fluid flow path by a fluid heating device from the initial temperature to an outlet temperature.

There has thus been outlined, rather broadly, some of the more important elements of the disclosure in order that the detailed description thereof that follows may be better understood, and in order that the present contribution to the art may be better appreciated. There are additional elements of the disclosure that will be described hereinafter and which will form the subject matter of the claims appended hereto.

In this respect, before explaining at least one embodiment or implementation in greater detail, it is to be understood that the scope of the disclosure is not limited in its application to the details of construction and to the arrangements of the components, as well as the particulars of the steps, set forth in the following description or illustrated in the drawings. The disclosure is capable of other embodiments and implementations and is thus capable of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present disclosure. It is important, therefore, that the claims be regarded as including such equivalent constructions insofar as they do not depart from the spirit and scope of the present disclosure.

The advantages of the various embodiments of the present disclosure, along with the various features of novelty that characterize the disclosure, are disclosed in the following descriptive matter and accompanying drawings.

BRIEF DESCRIPTION OF THE DRAWINGS

The disclosure will be better understood and when consideration is given to the drawings and the detailed description which follows. Such description makes reference to the annexed drawings wherein.

DETAILED DESCRIPTION

Figure 1:
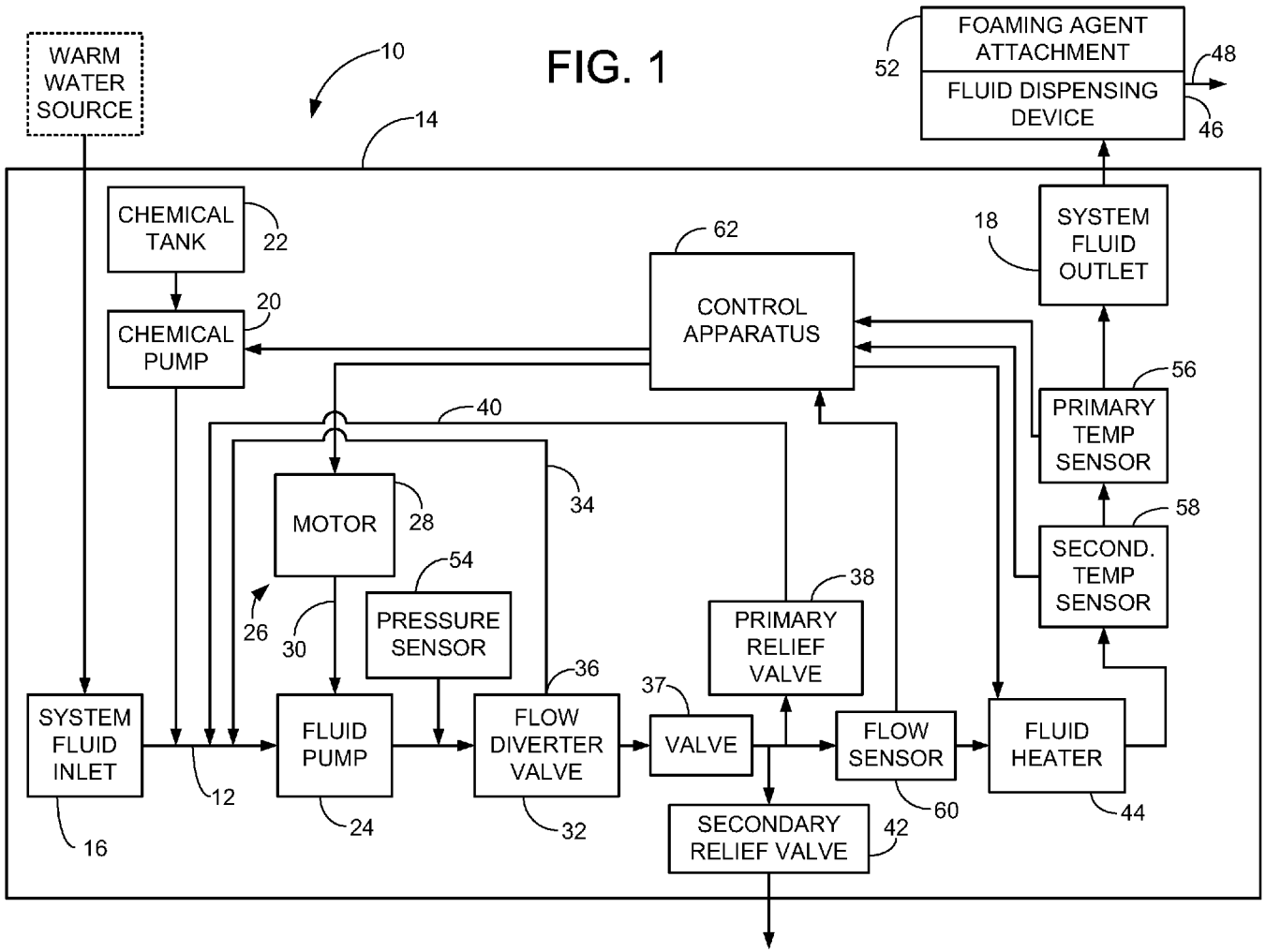
FIG. 1 is a schematic diagram of a new washing system according to the present disclosure.
Figure 2:
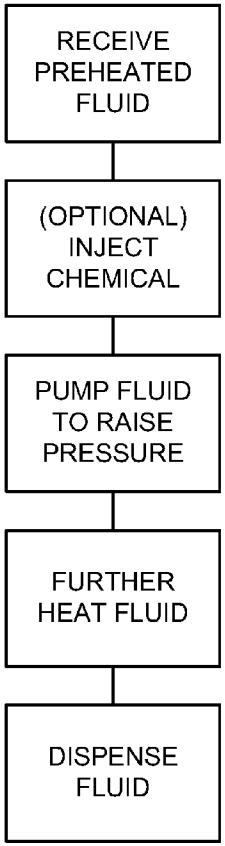
FIG. 2 is a schematic flow diagram of a new washing method for a system according to the present disclosure.

With reference now to the drawings, and in particular to FIGS. 1 and 2 thereof, a new washing system and method embodying the principles and concepts of the disclosed subject matter will be described.

Applicants have recognized that while conventional hot water and steam cleaning systems have the capability to heat and pressurize fluids such as water from virtually any temperature including the temperature that water is available from a well or municipal water supply through a tap or direct connection in a building, which typically has a temperature below approximately 90 degrees F. (approximately 32 degrees C.), and may be in the range of approximately 45 degrees F. (approximately 7 degrees C.) to approximately 80 degrees F. (approximately 26 degrees C.), the size and expense and power usage of such systems often makes those systems impractical for (and thus not used in) some facilities where cleaning with hot fluid and steam cleaners could provide a significant benefit. However, such systems, if used in restaurants and similar facilities, have substantial benefits in that substances such as fats and oils are relatively easily removed using very hot water, or a combination of steam and very hot water, while using relatively smaller amounts of water, which reduces the amount of cleaning water to be disposed of during and after the cleaning operation.

Applicants have also recognized that utilizing the water available from the conventional water heater of the facility, which is usually available at temperatures of approximately 100 degrees F. (approximately 37 degrees C.) to approximately 160 degrees F. (approximately 70 degrees C.), to feed a system for heating and pressurizing the water to temperatures and pressures that allow for effective hot water and steam cleaning allows the system to be significantly reduced in size and power usage, meaning that the resulting unit may be easily positioned in a restaurant kitchen without excessive space requirements and plugged into an available electrical outlet without high power requirements. The temperature of the water at the outlet of the system may be greater than approximately 150 degrees F. (approximately 65 degrees C.), and typically may be in the range of approximately 175 degrees F. (approximately 80 degrees C.) to approximately as high as 350 degrees F. (approximately 176 degrees C.).

For example, if a fast food restaurant has a water source of 45 degrees F. and steam cleaning performance at a flow rate of 0.6 gallons per minute and 320 degrees F. is desired, but the restaurant building has a 240 Volt 1 phase electrical service available, a cleaning apparatus providing this level of performance would require a 125 amp circuit. This large capacity circuit is not commonly available in the building of a smaller business. However, if the same restaurant has a water heater (which is common) providing water at 160 degrees F., a cleaning apparatus providing the same level of performance would only require an 80 amp circuit.

Applicants have invented a system 10 for heating and pressurizing fluid that takes advantage of this recognition to provide several benefits that will become evident from the following description. The invention can therefore make it possible for a large number of businesses to use an existing electric circuit to provide a high capacity steam cleaner/hot water washer, which would otherwise be difficult if impossible to achieve. Thousands of businesses (such as restaurants and food service businesses) can benefit from this invention.

In general, the system 10 may take in fluid at an initial fluid temperature in a range of between approximately 60 degrees F. (approximately 15 degrees C.) and approximately 180 degrees F. (approximately 82 degrees C.), and may outlet the fluid at an outlet temperature in a range between approximately 140 degrees F. (approximately 60 degrees C.) and approximately 350 degrees F. (approximately 176 degrees C.). Further, the pressure of the fluid may also be raised to pressures in the range of between approximately 250 psi (approximately 1.7 MPa) and approximately 3000 psi (approximately 20 MPa). In a broad sense, the temperatures and pressures of the fluid taken in by the system 10 are typical of the output of a conventional water heater commonly found in a building and designed for supplying the hot water for general dish washing purposes, but of a temperature insufficient to sanitize and efficiently remove grease from cooking equipment.

The system 10 is preferably (although not necessarily) located entirely, or substantially entirely, in a single housing 14 of a size and shape that is convenient for positioning, for example, in the food preparation kitchen of a food related business, such as a restaurant, grocery store or other place where food is prepared. The housing 14 may form an enclosure with an interior in which the components of the system 10 are located.

The system 10 defines a primary fluid flow path 12 along which the fluid travels through the system between a fluid inlet 16 that defines an inlet into the primary fluid flow path for receiving fluid at the initial or inlet fluid temperature, and a fluid outlet 18 that defines an outlet from the primary fluid flow path for the fluid. The following description will use the convention that the outlet 18 is "downstream" from the inlet 16, and the inlet is "upstream" from the outlet. Flow rates though the primary fluid flow path may vary, particularly if hot water or steam is being outputted by the system. For example, the flow of fluid through the primary fluid flow path may be approximately 1.1 gallons per minute (approximately 4.2 liters per minute) if hot water is being produced, and may be reduced to approximately 0.6 gallons per minute (approximately 2.3 liters per minute) if steam and water is being produced.

The fluid inlet 16 is configured to connect to a fluid source such as a tap or faucet by a hose, or in some implementations may be more permanently installed using pipe. The fluid outlet 18 may be connectable to a fluid dispensing device through a conduit such as a flexible hose or pipe. The fluid inlet 16 and the fluid outlet 18 may each comprise a fitting mounted on the housing 14 that allows for attachment and detachment of conduits using, for example, threaded connectors, although other manners of connection may also be implemented.

In some embodiments of the system 10, apparatus for adding a chemical to the fluid may be provided. In such implementations, the system 10 may include a chemical pump 20 in fluid communication with the primary fluid flow path to add a chemical to the fluid in the fluid flow path, and may also include a chemical tank 22 in fluid communication with chemical pump such that the chemical in the interior of the chemical tank is pumped out of the interior and into the primary fluid flow path. Illustratively, the chemical may comprise a cleaning solution such as a soap or a detergent. The pump 20 and tank 22 may be housed in or on the housing 14.

The system 10 may also include a fluid pump 24 in fluid communication with the primary fluid flow path 12. The pump 24 may be configured to move fluid along the fluid flow path 12 and through the various components of the system between the inlet 16 and outlet 18. The fluid pump 24 is therefore in fluid communication with the inlet and outlet, and may be located relatively closely downstream from the fluid inlet.

The system 10 may include a motor assembly 26 that is configured to operate or drive the fluid pump 24. In some embodiments, the motor assembly 26 may comprise a motor 28 having a rotary output shaft and a power transfer apparatus 30 that is configured to transfer power between the motor and the primary pump. Illustratively, the power transfer apparatus 30 may comprise a driver pulley mounted on the motor, a driven pulley mounted on the primary pump, and a belt engaging the driver pulley and the driven pulley to transfer rotation between the pulleys. It will be recognized that other power transfer apparatus may be employed, such as a gear set, a hydraulic drive system, or a direct drive system. In the preferred embodiments, the motor assembly 26 is completely or substantially completely located in the interior of the housing 14.

The system 10 may also employ a flow diverter valve 32 that is in communication with the primary fluid flow path 12. The flow diverter valve 32 is configured to divert fluid flow from the primary fluid flow path 12 to a secondary fluid flow path 34 when the pressure of the fluid on the primary fluid flow path reaches approximately a first threshold pressure. Illustratively, the first threshold pressure is between approximately 300 psi (approximately 2 MPa) and approximately 800 psi (approximately 5.5 MPa), although these values are not critical. The secondary fluid flow path 34 may be in communication with the primary fluid flow path 12 at the flow diverter valve 32 and also at a location upstream of the fluid pump 24 to re-circulate fluid on the secondary fluid flow path through the fluid pump when flow through the fluid flow path 12 downstream of the valve 32 is blocked or otherwise stopped in order to keep the pump operating for stoppages of flow over time periods of short duration. In some implementations, a switch may be integrated into the flow diverter valve 32 may generate a signal that indicates the diversion status of the valve 32. The flow diverter valve may comprise an unloader valve with a secondary outlet 36 that is in fluid communication with the secondary fluid flow path 34.

A user-operable and adjustable valve 37 may be included in the system 10 in communication with the fluid flow path 12 to adjust the rate of fluid flow on the flow path 12 at the location of the user-operable valve. The user-operable valve 37 is operable or actuatable by the hand of the user to adjust fluid flow to elements of the system located downstream from the valve 37 thereby adjusting the volume of primary fluid flow through the system. In some embodiments, the valve 37 is located downstream from the fluid pump 24 and the flow diverter valve 32, and upstream from the pressure relief valve(s) to be described now.

The system 10 may include one or more pressure relief valves to limit the buildup of the pressure of the fluid in the primary fluid flow path 12. In some embodiments, a primary pressure relief valve 38 is provided that is in communication with the primary fluid flow path 12 and is responsive to pressure of the fluid in the primary fluid path to direct fluid flow to a tertiary fluid flow path 40 when pressure of the fluid in the primary fluid flow path 12 reaches approximately a second threshold pressure. Illustratively, the second threshold pressure is between approximately 1000 psi (approximately 7 MPa) and approximately 3400 psi (approximately 23 MPa), although these values are not critical. The primary pressure relief valve 38 may be configured to direct a portion of fluid flow from a point on the primary fluid flow path located downstream from the fluid pump to a point upstream of the fluid pump when pressure of the fluid flow reaches the second threshold pressure. Directing the fluid from the primary pressure relief valve 38 back to the primary path 12 may avoid in most cases the need to exhaust the fluid to the environment, which in the case of a kitchen environment might drain fluid to an area that may cause a nuisance or even a hazard.

The system 10 may also include a secondary pressure relief valve 42 that is in communication with the primary fluid flow path and that is also responsive to pressure of the fluid in the primary fluid path 12. The secondary pressure relief valve 42 may direct fluid flow to the environment exterior of the housing 14 when the pressure of the fluid in the primary fluid flow path reaches approximately a third threshold pressure. Preferably, but not critically, the second threshold pressure is less than the third threshold pressure, so that excessive pressure in the primary fluid flow path initially causes a diversion of fluid back to the primary fluid flow path through the primary pressure relief valve and the tertiary fluid flow path, and only then if the excess pressure situation cannot be remedied in that manner, the fluid is exhausted to the environment. Illustratively, the third threshold pressure is between approximately 1100 psi (approximately 7.5 MPa) and approximately 3600 psi (approximately 25 MPa), although these values are not critical.

A fluid heating device 44 of the system 10 is provided in communication with the primary fluid flow path 12 and is configured to heat fluid passing through the fluid heating device, and the primary fluid flow path passes through the device 44. In the most preferred embodiments, the heating device is electrically powered without a combustion burner utilized to heat the fluid, and thus no potentially toxic fumes are generated that need to be vented, which facilitates a portable and compact configuration for the system. Since the fluid heater device is preferably supplied fluid at a temperature above approximately 140 degrees F. (approximately 60 degrees C.) to approximately 160 degrees F. (approximately 70 degrees C.), the size or capacity of the fluid heater device may be relatively smaller, with smaller power requirements, than if the fluid heater device was required to heat the fluid from a temperature of approximately 60 degrees F. (approximately 15 degrees C.).

The fluid heating device 44 may be of a size or heating capacity that is incapable of heating the fluid in the primary fluid flow path 12 from inlet temperatures in a first inlet temperature range at the inlet 16 to an outlet temperature at the outlet 18 in an outlet temperature range at fluid flow rates in the path 12. The first inlet temperature range may be below approximately 60 degrees F. (approximately 15 degrees C.), and the outlet temperature range may be above approximately 140 degrees F. (approximately 60 degrees C.). The fluid heating device 44 may be of a size or heating capacity that is sufficient to heat the fluid in the primary fluid flow path from inlet temperatures in a second inlet temperature range to an outlet temperature in the outlet temperature range. The second inlet temperature range may be approximately equal to or above approximately 60 degrees F. (approximately 15 degrees C.), and the outlet temperature range may be above approximately 140 degrees F. (approximately 60 degrees C.).

A fluid dispensing device 46 may be associated with the system 10, and may or may not be a part of the system 10. In some embodiments, the fluid dispensing device 46 comprises a spray gun that is configured to be supported in the hand of a user and may be fluidly connected to the fluid outlet 18 by a conduit such a flexible hose. The spray gun may comprise a spray outlet 48 that is configured to outlet the fluid from the primary fluid flow path 12 to the environment in a spray or stream of fluid. The spray gun may further comprise a flow valve that is configured to control the flow of fluid from the primary fluid flow path through the spray outlet 48, so that the user holding the spray gun is able to initiate and terminate the flow. Typically, the flow valve will be actuated by a trigger which is configured for actuation by the hand of the user holding the spray gun. Optionally, a foaming agent attachment 52 may be utilized with the spray gun and is configured to inject a chemical foaming fluid into the flow of fluid in the primary fluid flow path at the spray gun. The foaming agent attachment 52 may be removably attachable to the spray gun.

The system may also include sensors of a sensor assembly that are configured to sense various operational aspects of the system for controlling various operational aspects of the system. The sensor assembly may comprise, for example, a pressure sensor 54 that is in communication with the primary fluid flow path 12 to sense the pressure of fluid in the fluid flow path, and may have a display that indicates the pressure level that is sensed. In some embodiments, the pressure sensor 54 is a pressure gauge with a dial that may be visible from the exterior of the housing 14.

The sensor assembly may also include a primary temperature sensor 56 that is configured to sense a temperature of the fluid in the primary fluid flow path 12 and may be in communication with the fluid in the flow path 12, and may be positioned along the path 12 between the fluid heating device 44 and the fluid dispensing device 46. The primary temperature sensor 56 may generate a primary temperature signal that corresponds to the temperature of the fluid at the primary temperature sensor as sensed by the sensor 56. The sensor assembly may also comprise a secondary temperature sensor 58 that is also configured to sense a temperature of the fluid in the primary fluid flow path 12, and may be positioned along the flow path 12 between the fluid heating device 44 and the fluid dispensing device 46. The secondary temperature sensor 58 may generate a secondary temperature signal that corresponds to the temperature of the fluid at the secondary temperature sensor.

The sensor assembly may also include a flow sensor 60 that is configured to sense the flow (or lack of flow) of fluid through and out of the fluid dispensing device 46. The flow sensor 60 is in fluid communication with the primary fluid flow path 12, and thus is in fluid communication with the fluid dispensing device. The flow sensor 60 may generate a flow signal that corresponds to a condition of fluid flow through the fluid dispensing device, and may signal flow or no flow, as well as a magnitude of the flow.

The system may also include a control apparatus 62 that is configured to control operation in response to operator input and input from the various sensors of the sensor assembly. The control apparatus 62 may be in communication with the primary temperature sensor 56 to receive the primary temperature signal, and the sensed temperature may be used as a basis for controlling the level of supply power to the fluid heating device 44. One highly suitable apparatus for performing this function is disclosed in U.S. Pat. No. 6,056,207 which is hereby incorporated by reference in its entirety.

The control apparatus 62 may also be in communication with the secondary temperature sensor 58 to receive the secondary temperature signal from the sensor 58. The signal from the secondary temperature sensor may be utilized to trigger a warning device and/or shut off the fluid heater 44 in case of an over or excessive temperature condition. Illustratively, the warning device may comprise a visual indicator such as over temperature indicator light located on the housing 14, although audible or other perceptible means of communicating a warning to an operator may be utilized. The sensor signal may trigger illumination of the light when the sensed temperature exceeds a threshold temperature. The sensor signal may also trigger shut off of the fluid heater 44 for a period of time during which the fluid can be allowed to return below a threshold temperature.

The control apparatus 62 may also be in communication with the flow sensor 60 to receive the flow signal, and the flow signal may be used to control the operation of the motor 26 (and the pump 24) and electric heater 44 based upon the value of the signal. The control apparatus 62 may also be in communication with the chemical pump 20 to control the flow of the chemical from the chemical tank 22 to the flow path.

In another aspect, a method of heating and pressurizing fluid for cleaning is disclosed, and includes receiving a fluid at an initial temperature at an inlet 16 of a primary fluid flow path 12 of a system 10 for heating and pressurizing fluid. The fluid has been preheated prior to being received by the system, and has been raised to the initial temperature by, for example, the plumbing of a building which typically includes a water heater that raises the temperature of the water to approximately 60 degrees F. or higher. The initial temperature of fluid may be characterized by being above approximately 60 degrees F. (approximately 15 degrees C.), and may include receiving fluid heated by a fluid heater that supplies heated fluid to the plumbing of a building, and may also include receiving the fluid from the fluid heater through plumbing pipes of the building, such as by connection to a spigot or faucet of the building. The method may optionally include injecting a chemical into the fluid in the primary fluid flow path 12 of the system by a chemical pump 20. The method may further comprise pumping the fluid in the primary fluid flow path 12 to increase the pressure of the fluid in the flow path. The method may also include heating the fluid in the fluid flow path 12 by the fluid heating device 44 from the initial temperature to an outlet temperature.

With respect to the above description then, it is to be realized that the optimum dimensional relationships for the parts of the disclosed embodiments and implementations, to include variations in size, materials, shape, form, function and manner of operation, assembly and use, are deemed readily apparent and obvious to one skilled in the art in light of the foregoing disclosure, and all equivalent relationships to those illustrated in the drawings and described in the specification are intended to be encompassed by the present disclosure.

Therefore, the foregoing is considered as illustrative only of the principles of the disclosure. Further, since numerous modifications and changes will readily occur to those skilled in the art, it is not desired to limit the disclosed subject matter to the exact construction and operation shown and described, and accordingly, all suitable modifications and equivalents may be resorted to that fall within the scope of the claims.

We claim:

1. A system for heating and pressurizing fluid to an outlet temperature and an outlet pressure, the system defining a primary fluid flow path, the system comprising:

a fluid inlet defining an inlet into the primary fluid flow path for receiving fluid at an initial fluid temperature;

a fluid outlet defining an outlet from the primary fluid flow path;

a fluid pump in fluid communication with the primary fluid flow path and configured to raise the pressure of the fluid moving along the fluid path;

a flow diverter valve in communication with the primary fluid flow path and configured to divert fluid flow from the primary fluid flow path to a secondary fluid flow path when pressure of the fluid on the primary fluid flow path reaches a first threshold pressure;

a fluid heating device in communication with the primary fluid flow path and configured to heat fluid passing through the fluid heating device, the fluid heating device being incapable of heating the fluid in the primary fluid flow path from a first inlet temperature range to the outlet temperature in an outlet temperature range, the fluid heating device being capable of heating the fluid in the primary fluid flow path from a second inlet temperature range to the outlet temperature in the outlet temperature range; and a primary pressure relief valve in communication with the primary fluid flow path and being responsive to pressure of the fluid in the primary fluid path to direct fluid flow to a tertiary fluid flow path when pressure of the fluid in the primary fluid flow path reaches approximately a second threshold pressure;

wherein the primary pressure relief valve is configured to direct a portion of fluid flow from a diversion point on the primary fluid flow path downstream from the fluid pump to a point upstream of the fluid pump when pressure of the fluid flow reaches the second threshold pressure, the diversion point being upstream of the fluid heating device in the fluid flow path.

2. The system of claim 1 wherein the first inlet temperature range is below approximately 60 degrees F., and wherein the outlet temperature range is above approximately 140 degrees F.

3. The system of claim 1 additionally comprising a housing, the fluid inlet, fluid outlet, fluid pump, flow diverter valve and fluid heating device being mounted on the housing.

4. The system of claim 3 wherein the housing comprises an enclosure defining an interior, the fluid inlet, fluid outlet, fluid pump, flow diverter valve and fluid heating device being mounted in the interior of the housing such that the system is self contained in the housing.

5. The system of claim 1 additionally comprising a chemical pump in fluid communication with the primary fluid flow path to add a chemical to the fluid in the fluid flow path.

6. The system of claim 5 additionally comprising a chemical tank in fluid communication with chemical pump such that a chemical in an interior of the chemical tank is pumped out of the interior into the primary fluid flow path.

7. The system of claim 1 additionally comprising a motor assembly configured to drive the fluid pump.

8. The system of claim 1 wherein the secondary fluid flow path is in communication with the primary fluid flow path upstream of the fluid pump to re-circulate fluid on the secondary fluid flow path through the fluid pump.

9. The system of claim 1 wherein the flow diverter valve comprises an flow diverter valve with a secondary outlet, the secondary outlet of the flow diverter valve being in communication with the secondary fluid flow path.

10. The system of claim 1 additionally comprising a user-operable valve in communication with the fluid flow path and being configured to adjust a rate of fluid flow on the primary fluid flow path at the user-operable valve in response to user actuation.

11. The system of claim 1 additionally comprising a fluid dispensing device in fluid communication with the fluid outlet to receive fluid from the primary flow path.

12. The system of claim 11 additionally comprising a foaming agent attachment configured to inject a chemical foaming fluid into the flow of fluid at the fluid dispensing device.

13. A system for heating and pressurizing fluid to an outlet temperature and an outlet pressure, the system defining a primary fluid flow path, the system comprising a fluid inlet defining an inlet into the primary fluid flow path for receiving fluid at an initial fluid temperature;

a fluid outlet defining an outlet from the primary fluid flow path;

a fluid pump in fluid communication with the primary fluid flow path and configured to raise the pressure of the fluid moving along the fluid path;

a flow diverter valve in communication with the primary fluid flow path and configured to divert fluid flow from the primary fluid flow path to a secondary fluid flow path when pressure of the fluid on the primary fluid flow path reaches a first threshold pressure;

a fluid heating device in communication with the primary fluid flow path and configured to heat fluid passing through the fluid heating device, the fluid heating device being incapable of heating the fluid in the primary fluid flow path from a first inlet temperature range to the outlet temperature in an outlet temperature range, the fluid heating device being capable of heating the fluid in the primary fluid flow path from a second inlet temperature range to the outlet temperature in the outlet temperature range; and a secondary pressure relief valve in communication with the primary fluid flow path and being responsive to pressure of the fluid in the primary fluid path to direct fluid flow to the environment when pressure of the fluid in the primary fluid flow path reaches approximately a third threshold pressure.

14. The system of claim 13 additionally comprising a primary pressure relief valve in communication with the primary fluid flow path and being responsive to pressure of the fluid in the primary fluid path to direct fluid flow to a tertiary fluid flow path when pressure of the fluid in the primary fluid flow path reaches approximately a second threshold pressure.

15. The system of claim 14 wherein the primary pressure relief valve is configured to direct a portion of fluid flow from a point on the primary fluid flow path downstream from the fluid pump to a point upstream of the fluid pump when pressure of the fluid flow reaches the second threshold pressure.

16. The system of claim 14 wherein the primary pressure relief valve is configured to direct a portion of fluid flow from a point on the primary fluid flow path downstream from the fluid pump to a point upstream of the fluid pump when pressure of the fluid flow reaches the second threshold pressure.

17. The system of claim 13 additionally comprising a chemical pump in fluid communication with the primary fluid flow path to add a chemical to the fluid in the fluid flow path.

18. The system of claim 17 additionally comprising a chemical tank in fluid communication with chemical pump such that a chemical in an interior of the chemical tank is pumped out of the interior into the primary fluid flow path.

19. The system of claim 13 additionally comprising a user-operable valve in communication with the fluid flow path and being configured to adjust a rate of fluid flow on the primary fluid flow path at the user-operable valve in response to user actuation.

20. A system for heating and pressurizing fluid to an outlet temperature and an outlet pressure, the system defining a primary fluid flow path, the system comprising:

a fluid inlet defining an inlet into the primary fluid flow path for receiving fluid at an initial fluid temperature;

a fluid outlet defining an outlet from the primary fluid flow path;

a fluid pump in fluid communication with the primary fluid flow path and configured to raise the pressure of the fluid moving along the fluid path;

a flow diverter valve in communication with the primary fluid flow path and configured to divert fluid flow from the primary fluid flow path to a secondary fluid flow path when pressure of the fluid on the primary fluid flow path reaches a first threshold pressure; and a fluid heating device in communication with the primary fluid flow path and configured to heat fluid passing through the fluid heating device, the fluid heating device being incapable of heating the fluid in the primary fluid flow path from a first inlet temperature range to the outlet temperature in an outlet temperature range, the fluid heating device being capable of heating the fluid in the primary fluid flow path from a second inlet temperature range to the outlet temperature in the outlet temperature range;

a housing comprising an enclosure defining an interior, the fluid inlet, fluid outlet, fluid pump, flow diverter valve and fluid heating device being mounted in the interior of the housing such that the system is self contained in the housing;

a chemical pump in fluid communication with the primary fluid flow path to add a chemical to the fluid in the fluid flow path;

a chemical tank in fluid communication with chemical pump such that a chemical in an interior of the chemical tank is pumped out of the interior into the primary fluid flow path;

a motor assembly configured to drive the fluid pump;

wherein the secondary fluid flow path is in communication with the primary fluid flow path upstream of the fluid pump to re-circulate fluid on the secondary fluid flow path through the fluid pump;

wherein the flow diverter valve comprises a flow diverter valve with a secondary outlet, the secondary outlet of the flow diverter valve being in communication with the secondary fluid flow path;

a fluid dispensing device in fluid communication with the fluid outlet to receive fluid from the primary flow path;

a foaming agent attachment configured to inject a chemical foaming fluid into the flow of fluid at the spray gun;

a primary pressure relief valve in communication with the primary fluid flow path and being responsive to pressure of the fluid in the primary fluid path to direct fluid flow to a tertiary fluid flow path when pressure of the fluid in the primary fluid flow path reaches approximately a second threshold pressure;

wherein the primary pressure relief valve is configured to direct a portion of fluid flow from a point on the primary fluid flow path downstream from the fluid pump to a point upstream of the fluid pump when pressure of the fluid flow reaches the second threshold pressure; and a secondary pressure relief valve in communication with the primary fluid flow path and being responsive to pressure of the fluid in the primary fluid path to discharge fluid flow to the environment when pressure of the fluid in the primary fluid flow path reaches approximately a third threshold pressure.

* * * * *